US005341865A

United States Patent [19]

Fraser et al.

[11] Patent Number: 5,341,865

[45] Date of Patent: Aug. 30, 1994

[54] TILTER MECHANISMS FOR A VENETIAN BLIND

[75] Inventors: Donald E. Fraser, Owensboro; Richard N. Anderson, Whitesville, both of Ky.

[73] Assignee: Hunter Douglas Inc., Upper Saddle River, N.J.

[21] Appl. No.: 43,978

[22] Filed: Apr. 7, 1993

Related U.S. Application Data

[63] Continuation of Ser. No. 832,744, Feb. 7, 1992, abandoned.

[51] Int. Cl.[5] ..... E06B 9/26

[52] U.S. Cl. ..... 160/176.1; 160/178.1

[58] Field of Search ..... 160/178.1, 168.1, 176.1, 160/177

[56] References Cited

U.S. PATENT DOCUMENTS

| | | | |
|---|---|---|---|
| D. 329,350 | 9/1992 | Jian . | |
| D. 331,517 | 12/1992 | Warner . | |
| D. 335,059 | 4/1993 | Schaefer et al. . | |
| 2,495,888 | 1/1950 | Burns | 160/176 |
| 2,667,220 | 1/1954 | Rutledge | 160/177 |
| 2,701,012 | 2/1955 | Loucony | 160/176.1 |
| 2,709,488 | 5/1955 | Lorentzen | 160/176.1 |
| 3,269,453 | 8/1966 | Vechiarelli et al. | 160/176.1 |
| 3,630,264 | 12/1971 | Debs et al. | 160/177 |
| 3,921,695 | 11/1975 | Debs | 160/176 |
| 4,214,622 | 7/1980 | Debs | 160/168 |
| 4,262,728 | 4/1981 | Debs | 160/168 |
| 4,494,593 | 1/1985 | Fielder, Jr. | 160/177 |
| 4,541,468 | 9/1985 | Anderson | 160/177 |
| 4,697,629 | 10/1987 | Anderson | 160/177 |
| 4,719,955 | 1/1988 | Tachikawa et al. | 160/176.1 X |
| 4,821,789 | 4/1989 | Van Rens | 160/176.1 |
| 4,945,971 | 10/1990 | Ivarsson et al. | 160/178.3 |
| 5,074,349 | 12/1991 | Yannazzone | 160/176.1 X |

FOREIGN PATENT DOCUMENTS

| | | | |
|---|---|---|---|
| 263311 | 7/1968 | Austria | 160/176.1 |
| 598222 | 9/1959 | Italy | 160/176.1 |
| WO91/14848 | 10/1991 | PCT Int'l Appl. . | |
| 158259 | 3/1957 | Sweden . | |
| 765419 | 1/1957 | United Kingdom . | |
| 1081975 | 9/1967 | United Kingdom . | |

*Primary Examiner*—Blair M. Johnson

[57] ABSTRACT

A tilt roll and tilt roll mechanism for a venetian blind are disclosed, designed to tilt the ladder laces of a venetian blind. The tilt roll body preferably has an asymmetric cross-section and is provided with bearings engaging bearings on a support and the elongate flexible cords of the ladder lace extend around at least a portion of the periphery of the body, one on each side. The cords are engaged on elements integrally molded to the body and these are each adapted to be engaged by one of the cords, effective to deform and retain the cord. The engaging elements may include a spike which is used to be pierced through a part of the cord, or by resiliently mounted flaps, or by radially outwardly extending jaws.

Means are also disclosed for preventing the tilt roll from being rotated more than 360° and the configuration is such as to ensure that the top slat does not become retained by one of the tilt cords as the blind is moved from its closed to its open position.

7 Claims, 7 Drawing Sheets

TILTER MECHANISMS FOR A VENETIAN BLIND

This is a continuation, of application Ser. No. 07/832,744 , filed Feb. 7, 1992 abandoned.

FIELD OF THE INVENTION

This invention relates to a tilter mechanism for venetian blinds, as well as to venetian blinds using such mechanisms and tilt rolls for use therein.

BACKGROUND TO THE INVENTION

Tilter mechanisms for venetian blinds are used to cooperate with the ladder lace of the venetian blinds and one always has two and sometimes more of these ladder laces, depending on the width of the blind, to support the slats. The ladder laces each comprise two laterally spaced elongate flexible cords or tapes and a plurality of longitudinally spaced, transversely extending rungs, joining said elongate flexible cords.

The elongate flexible cords are conventionally attached by one means or another to a tilt roll which is usually mounted in the head rail of the blind. All of the tilt rolls are simultaneously tilted in one direction or the other to cause opposite longitudinal movement of the elongate flexible cords, and thereby tilting of the rungs and the slats supported thereon. Various different types of controls may be provided to effect the tilting. In most instances the control mechanism operates on a tilt rod, usually of polygonal cross-section, which passes along the length of the head rail and engages on each of the tilt rolls.

The tilt rolls themselves usually have some gripping element usually in the form of a metal plate or tab, which is used to engage the elongate flexible cords which themselves are often knotted or provided with a metal bead or grommet at this location in order to secure to the tilt roll.

Such mechanisms are relatively complex and the mounting of the ladder laces on these tilt rolls can be awkward and time consuming.

SUMMARY OF THE INVENTION

It is an object of the invention to overcome these difficulties and to provide a tilt roll and a mechanism associated therewith which is capable satisfactorily of operating blinds having slats of different widths and even relatively large widths on a tilt mechanism which is comparatively small being mounted in a narrow gauge head rail.

The invention provides a tilt roll for tilting a ladder lace of a venetian blind, said ladder lace comprising two laterally spaced elongate flexible cords and a plurality of longitudinally spaced, transversely extending rungs joining said elongate flexible cords, said tilt roll comprising, in combination:

a) a one piece plastic molded or cast metal body;
b) means on said body adapted to mount said body for rotation about an axis;
c) a peripheral surface on said body about which an end portion of said elongate flexible cords may be at least partly wound, whereby rotation of said body causes opposite longitudinal movement of said elongate flexible cords, and thereby tilting of said rungs; and
d) at least two spaced cord engaging elements integrally molded to said body and each adapted to be engaged by one of said elongate flexible cords, effective to deform and retain said cord.

The cord engaging elements may take a number of different forms. According to one form it is proposed that they should comprise an axially extending spike having one end molded to the body and another free, sharp end, adapted to be pressed through the associated cord, or through loops formed on the associated cord. Each spike advantageously comprises a barb provided with said free, sharp end and a shoulder positioned at a distance from the body. The spikes may in fact extend in opposite axial direction and be circumferentially spaced from one another relative to the body.

In another structure each cord engaging element comprises a plate like member formed integrally with said body and a tapered slot, which is open at one end and closed at the other end, said open end being at the wider end of the taper, whereby one of said elongate flexible cords can be forced in from said wider, open end, effective to be deformed and retained by said plate like member as said cord is urged towards the narrower end of the taper.

In a further structure, the body comprises a first part and a second part and said cord engaging element comprises a flap, integrally molded in cantilever fashion to said first part of said body and having a free end adjacent said second part, whereby a cord can be engaged between said free end and said second part. With this structure, the free end of flap may comprise an elongate edge which may be at least partly inclined, whereby a cord can be passed freely between the partly inclined part and said second part of the body and then moved along said inclined edge to be gripped thereby in the direction of loading.

It is also contemplated that an abutment can be provided on the second part positioned substantially opposite the free edge of the flap, whereby a cord may be engaged between the free edge and the abutment.

In a yet further construction, a cord engaging element may comprise a pair of generally radially outwardly extending jaws formed integrally on said body.

The invention also contemplates a tilt mechanism for tilting a ladder lace comprising two laterally spaced elongate flexible cords and a plurality of longitudinally spaced, transversely extending rungs joining said elongate flexible cords, said mechanism being mountable in a venetian blind head rail, said tilt mechanism comprising, in combination:

a) a tilt roll body;
b) first bearing means on said body;
c) a tilt roll support having first and second ends and first and second sides;
d) second bearing means on said support adjacent said first and second ends and cooperatively engageable by said first bearing means;
e) means for mounting said tilt roll support in said venetian blind head rail; and
f) guide means in said support for guiding said two laterally spaced elongate flexible cords, said guide means defining spaced guide surfaces located closely adjacent said first and second sides of said support.

In the preferred structure the tilt roll support further includes a downwardly extending portion adapted to engage in an aperture in the head rail, said guide surfaces being formed adjacent end parts of the terminally extending body. With this form of structure according to the invention, it is possible significantly to reduce the angle between the two cords even if the slats are wider than the widest portion of the tilt roll and indeed wider than the head rail. This has the advantage that it enables one to dispense with the use of the so-called "tape spacer" and the blind will still operate satisfactorily without there being the problem of the top slat being retained in the tilted position at its upper edge by the elongate flexible element adjacent said upper edge when that elongate flexible element is caused to move downwardly, to move the slats to the open position. With this form of structure, relative dimensions of the parts are preferably such that the angle between the top slat, when the blind is in its fully open position, and the flexible cords for the ladder laces entering the head rail should be between 89° and 78°.

The invention also proposes a tilt roll mechanism wherein said first dimension is at least twice said second dimension. This structure also facilitates in the use of a venetian blind having slats which are generally wider than the head rail.

The invention also provides a tilt roll mechanism for tilting a ladder lace of a venetian blind, said ladder lace comprising two laterally spaced elongate flexible cords and a plurality of longitudinally spaced, transversely extending rungs joining said elongate flexible cords, said mechanism comprising:

a) a tilt roll body;

b) bearing means on said body for mounting said body for tilting motion about a tilting axis;

c) said tilt roll body having an asymmetric cross-section having first and second mutually perpendicular dimensions mutually transverse to said tilting axis, said cross-section first dimension being significantly greater than said cross-section second dimension;

d) control means controlling tilting movement of said tilt roll body, effective to restrict total tilting motion of said tilt roll body to significantly less than 360°; and e) a housing for said control means with a slot and removable cover which are effective to ease assembly of said control means.

The control means may comprise a worm and a pinion engaging said worm, a plurality of equally spaced teeth on said pinion around a portion only of the periphery of said pinion, but not the remainder, whereby the pinion will not be rotated by the worm beyond a point where the last tooth on said part before said remainder is in engagement with said worm. This protects the blind against over-tilting.

These and other objects of the invention will become more readily apparent to the man skilled in the art if reference is had to the following detailed description of presently preferred embodiment taken in conjunction with the accompanying drawings.

BRIEF DESCRIPTION OF THE DRAWINGS

FIGS. 9 and 10 are a view similar to FIGS. 3 and 4 of a venetian blind using the tilt roll of FIGS. 5 to 8;

DETAILED DESCRIPTION OF THE PRESENTLY PREFERRED EMBODIMENTS

Figure 1:
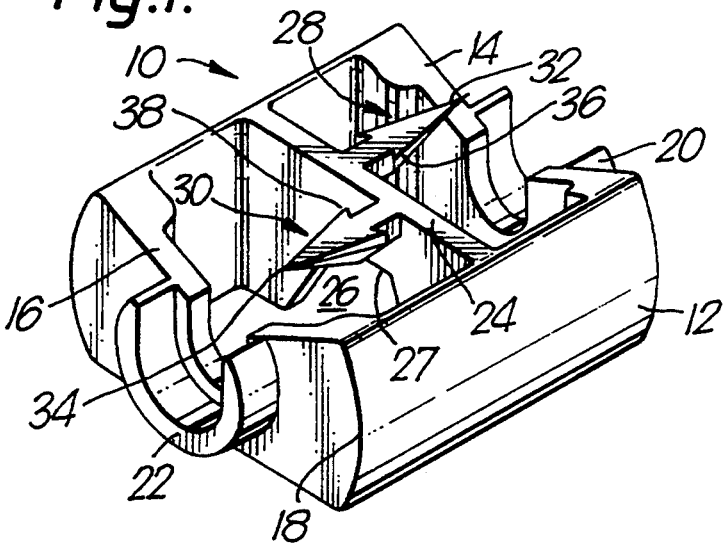
FIG. 1 is a perspective view of one embodiment of tilt roll according to the invention.

If reference is made to the drawings and first to FIG. 1, the tilt roll indicated by the general reference numeral 10 illustrated therein comprises a tilt roll body 12 formed with two end walls 14,16 and two part cylindrical peripheral side wall portions 18,20. The walls 14,16 carry axially extending part cylindrical bearing bosses 20,22 respectively. Parallel to the end walls 14,16 is a central cross wall 24 having an axially central notch 26 having an upper flat surface 27 extending laterally across the body.

Wall 24 carries two axially extending spikes 28,30 having sharpened points 32,34 and a barb forming a shoulder 36,38. It will be noted that the spikes 28,30 extend in opposite axial directions and are laterally off-set one with respect to the other.

Figure 2:
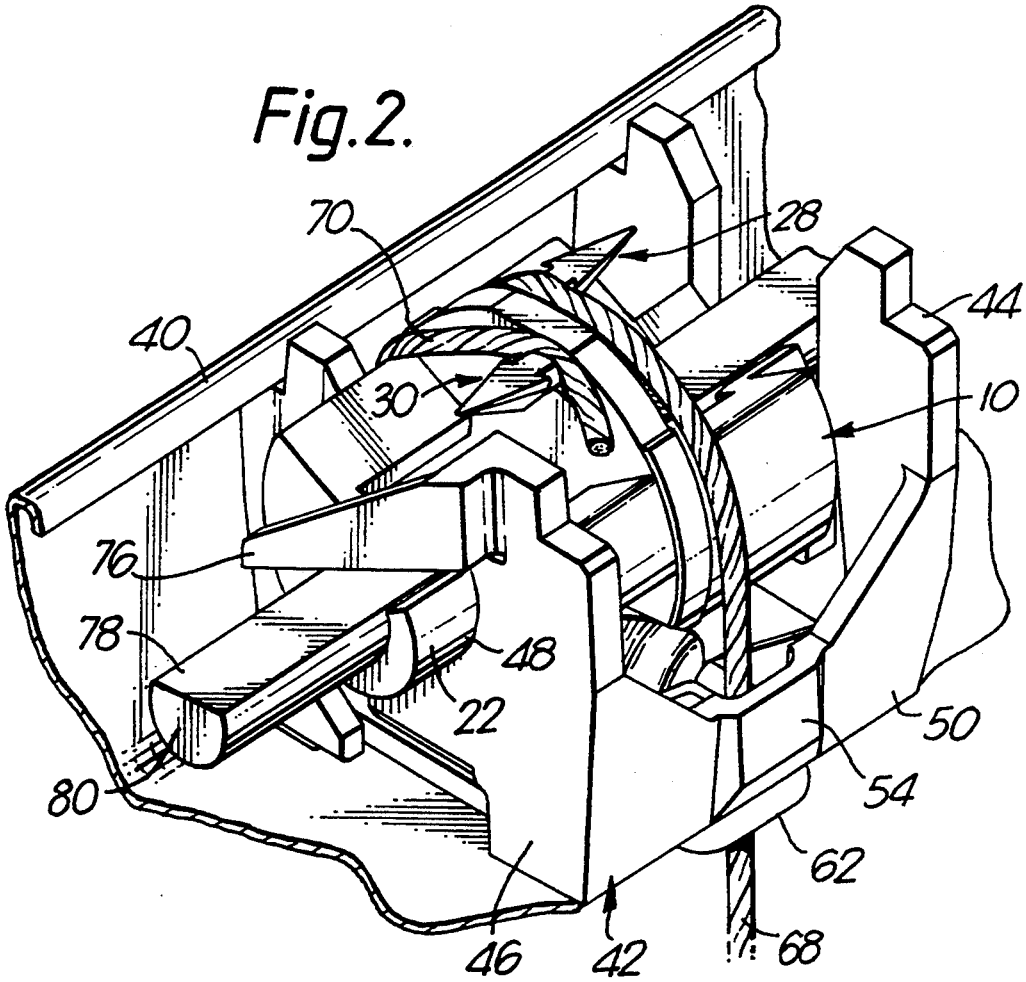
FIG. 2 is a perspective view showing the tilt roll of FIG. 1 mounted in a tilt roll support which in turn is carried in a head rail.

If reference is now made to FIG. 2, there is shown therein a head rail 40 in which is mounted a tilt roll support 42 with the tilt roll 10. The tilt roll support includes end walls 44,46 having second bearings 48 (only the one end wall 46 being visible in FIG. 2) in which the bearing portions 20,22 engage. Again bearing portion 22 only can be seen in FIG. 2. The support also includes side walls 50,52 (see FIGS. 3 and 4) including guide means 54,56 having guide surfaces 58,60 formed in a downwardly extending portion 62 engaged in an aperture 64 in the bottom wall of the head rail 40. It will be seen that the guide surfaces 58,60 are closely adjacent the first and second sides of the support, that is to say they are spaced as far apart as is practically possible.

Figure 3:
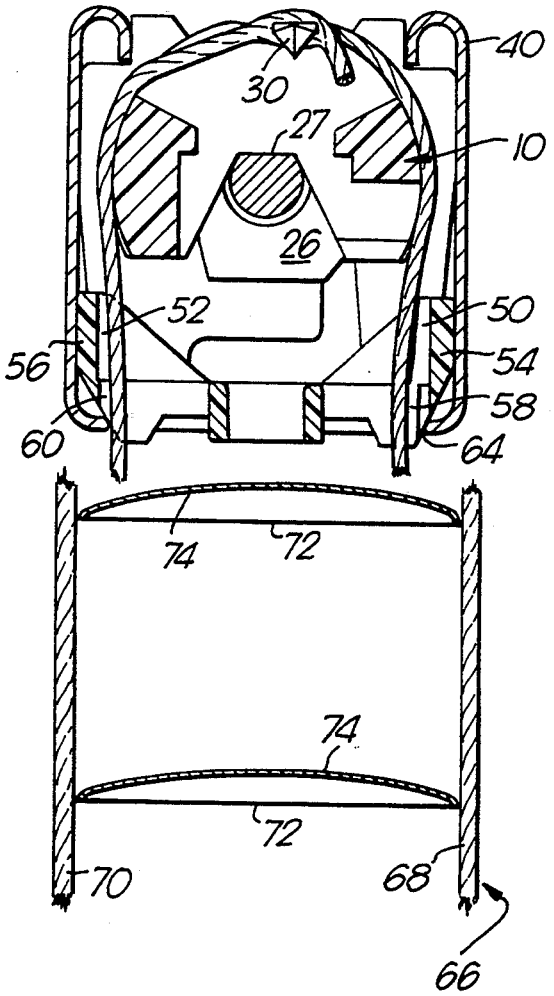
FIG. 3 is an end view of a venetian blind head rail with the arrangement of FIG. 2 therein, and with the blind in the open position.

FIG. 3 illustrates a ladder lace 66 having first and second laterally spaced elongate flexible cords 68,70 and a plurality of longitudinally spaced, transversely extending rungs 72 joining these cords 68,70 and shown supporting slats 74. The cords 68,70 pass one on each side of the tilt roll 10 and pass over the top. The spikes 28,30 are used to be pressed with their sharp ends through the cords 68,70, that is to say either through the cords themselves or through loops formed in the cords adjacent the rungs 72. Especially at the location of the junction of a rung and cord there is a natural looseness of braiding which allows easy insertion of the spike.

It can be seen that the support 42 is also provided with a resilient tongue 76 which is positioned to retain a tilt rod 80 which is passed through the tilt roll, a flat 78 on the tilt roll 80 engaging the flat surface 27 of the notch 26 formed in the central wall of the tilt roll 24. The shoulders 36,38 retain the spiked cord so that it cannot fall off. It will be appreciated that this method of mounting is very simple and that the tilt roll can readily be manufactured as a molding from a plastics material and the design is such as to enable one to use a relatively inexpensive two part mold for this purpose.

It will be observed that the depth, that is to say the vertical dimension as shown in FIG. 3, of the tilt roll 10 is relatively small compared with its width, as shown being approximately half the width.

Figure 4:
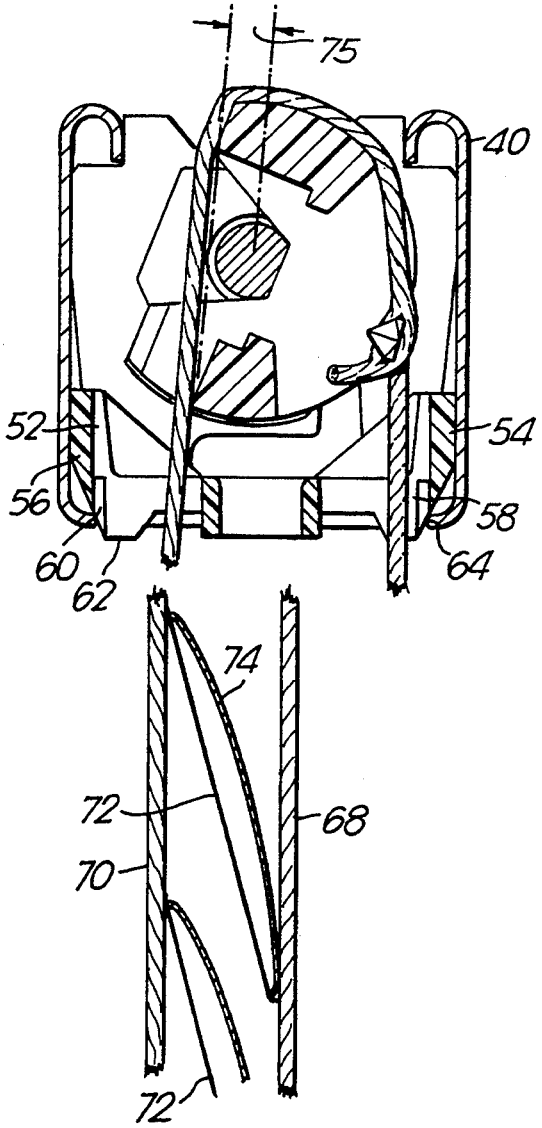
FIG. 4 is a similar view with the blind in a closed position.

If reference is made to FIG. 4, in which the blind is shown in its closed position, it will be seen that the configuration of the tilt body ensures that the lever arm 75 is relatively short to produce a tilt load which is reduced as compared with normal at this point of highest loading.

Figure 5:
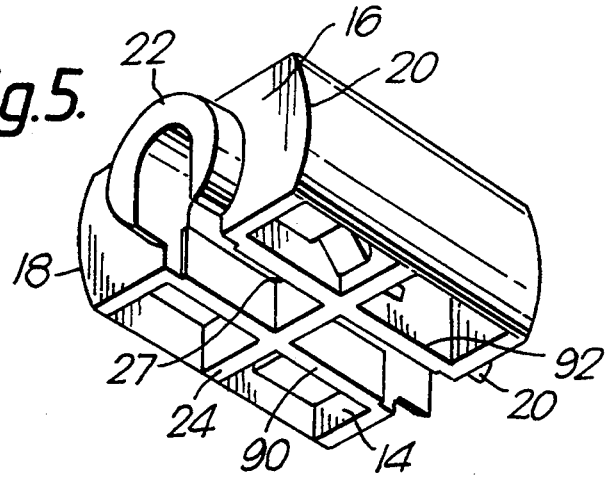
FIG. 5 is a perspective of a second embodiment of tilt roll according to the invention.

If reference is now made to FIG. 5, an alternative structure is illustrated and as many of the features are similar, like parts have been indicated by like reference numerals and reference will only be made to the differences. The main difference is that there are extending between the end walls 14,16 and the central wall 24 two longitudinal walls 90,92. Instead of having a recess similar to recess 26, the central wall 24 has a central non-circular aperture 29 of the same shape as the cross-section of the tilt rod 80.

Figure 6:
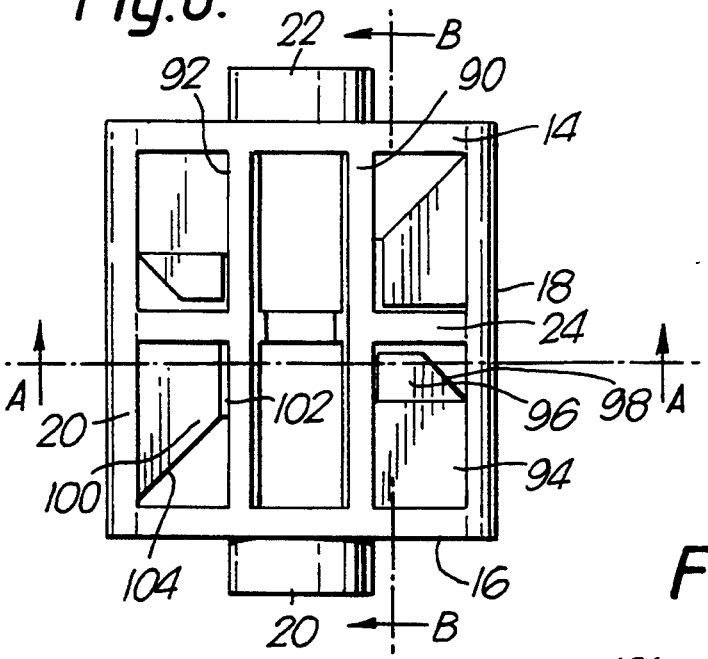
FIG. 6 is an enlarged plan view of the tilt roll of FIG. 5.
Figure 7:
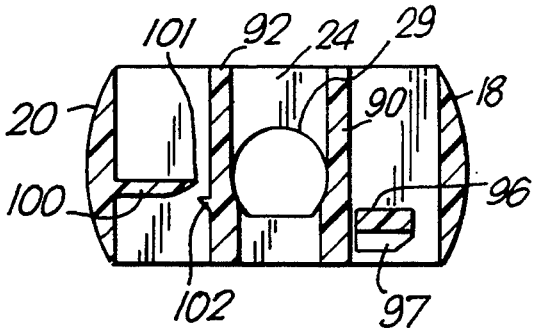
Figure 8:
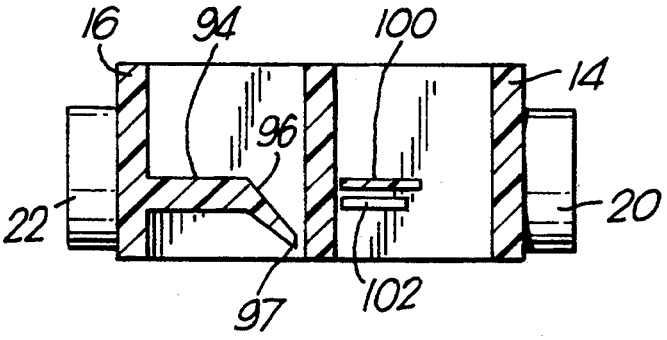

The longitudinal walls 90,92 provide four openings and in diagonally opposite, openings are arranged two sets of flaps and abutments, which are mirror images of one another, and only one of each will be described hereafter. In the bottom right, as seen in FIG. 6, a horizontal wall 96 is formed integrally with the wall 16 and has, at its free end, a downwardly inclined flap 96 with the free edge 97 spaced from central wall 24. As can be seen in the plan view of FIG. 6 there is an inclined edge 98 of the flap portion 96.

The other flap arrangement includes a flap 100 integral with the wall 20 and having a free edge spaced from the free edge 101. A short distance below this free edge 101 is an abutment 102 formed on the wall 92.

As can be seen in FIG. 6, the axially end portion of the flap 100 provides an inclined edge 104.

Figure 9:
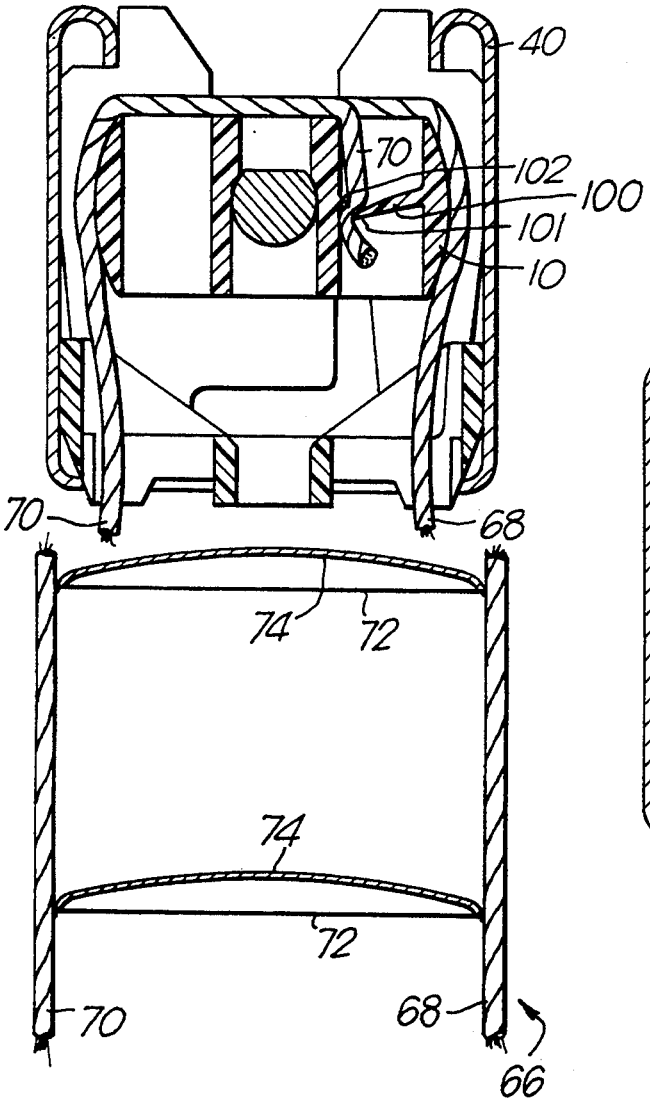
FIGS. 9 and 10 are sections on the lines A—A and B—B of FIG. 6.
Figure 10:
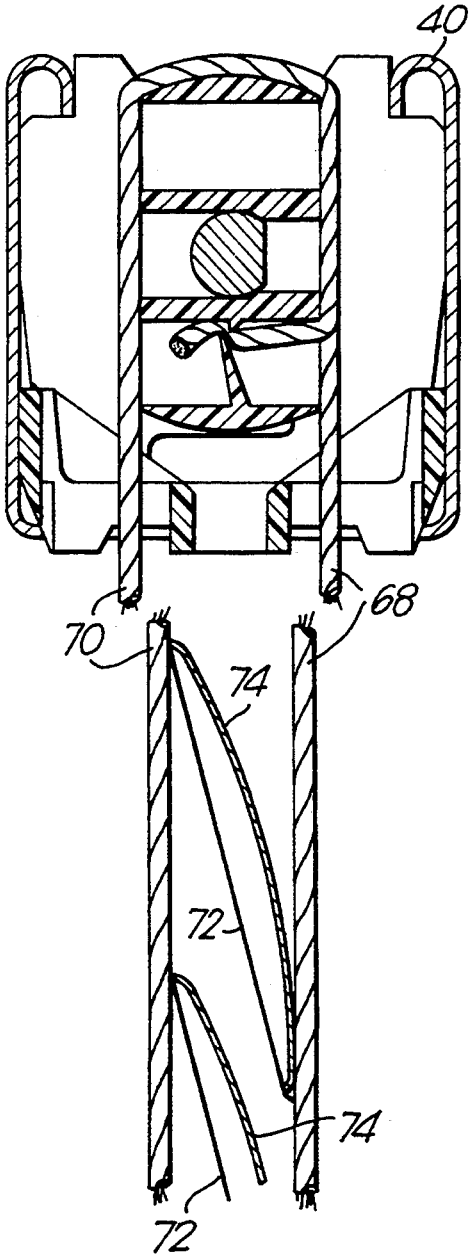

If reference is now made to FIG. 9, it will be seen that the cord 70 passes over the tilt roll 10 and is dropped down in the gap adjacent the edge 104. It is then slid along this edge and bends down the free end 101 of the flap 100, the cord being deformed and jammed between this free edge 101 and the abutment 102. In this way the cord is readily and simply secured in place. The other cord 68 is secured in a similar manner.

One could alternatively slide the cords between the flaps 96 and the central wall 24, the flap being displaced slightly by the cord. The flaps will react resiliently, to deform and retain the cords.

Figure 11:
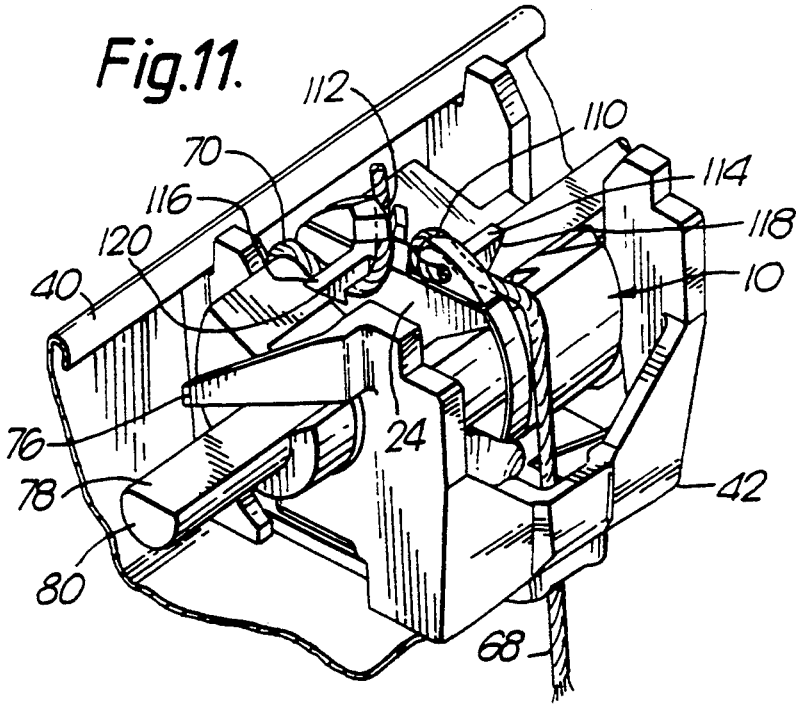
FIG. 11 is a view similar to FIG. 2 showing a further embodiment of tilt roll.

A further structure is illustrated in FIG. 11 which is similar to FIG. 2 and again, where appropriate, like parts are shown by like reference numerals. The one major difference here is that a central wall 24 is extended upwardly to provide two pairs of radially outwardly extending jaws 110,112, the spacing between the jaws being less than the thickness of the cords 68,70. These cords are inserted so that they pass under arms 114,116 extending axially in opposite directions from the wall 24 and provided, adjacent their free ends, with inclined head members 118,120. Having passed under these arms 110,112, the cords are pushed downwardly into the jaws 110,112 and are deformed and retained thereby.

Figure 12:
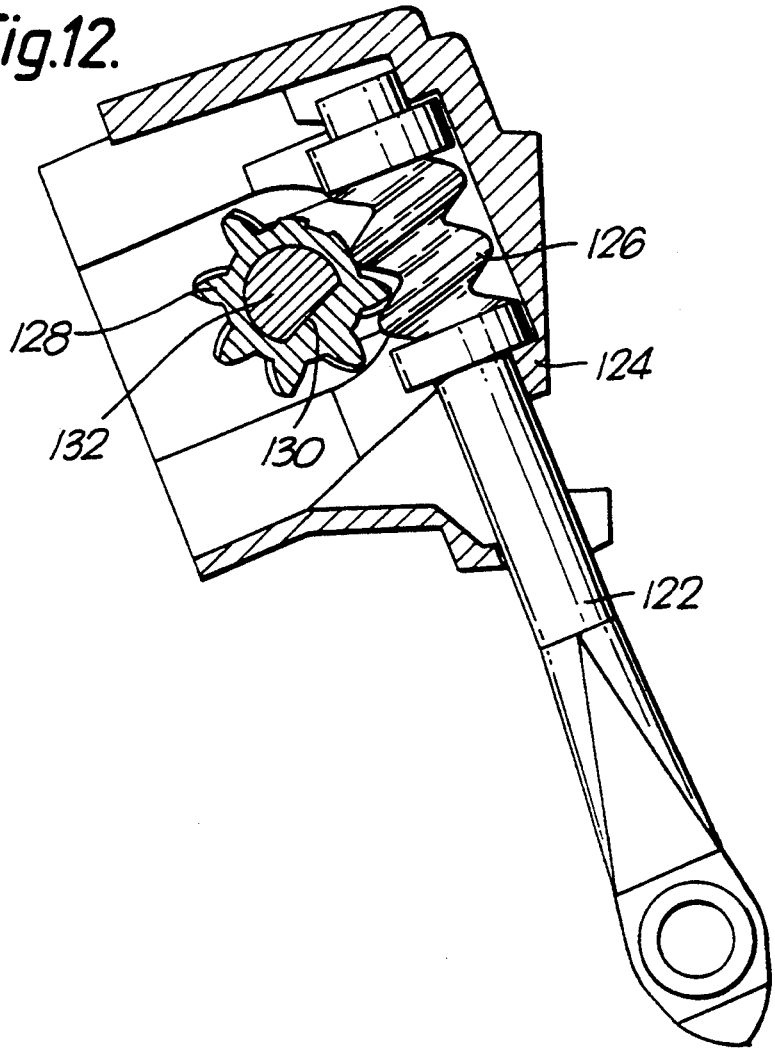
FIG. 12 is a section through one embodiment of tilt control gear mechanism according to the invention.

Any suitable means may be provided for tilting the shaft 80, but in a preferred structure illustrated in FIG. 12, a worm shaft 122 is rotatably mounted in a control means housing 124 and is provided at its upper end with a worm 126. This is engageable with one of a plurality of equally spaced teeth 130 on a pinion 128. The teeth 130 extend around a portion only of the periphery of the pinion, but not the remainder. It will be seen that as shown there are six teeth arranged at 45° relative to one another so that there are two teeth missing on the remainder, at the upper right portion as shown in FIG. 12. The pinion is formed with a central asymmetric opening 132 drivingly engageable over the tilt rod 80.

It will be appreciated that when the pinion is rotated by the worm, it will not rotate beyond a point where the last tooth on the pinion is in engagement with the worm. Thus, as shown, if the worm shaft 122 is rotated in a clockwise sense, as viewed from below, the pinion will not rotate any further than the position illustrated. If the wand is rotated in the counter-clockwise, the pinion will rotate counter-clockwise as seen in elevation in FIG. 12.

This arrangement ensures that the tilt rolls will not rotate as much as 360°, so there will be no likelihood of the elongate flexible cords 68,70 being over-wound on tilt roll 10.

Figure 15:
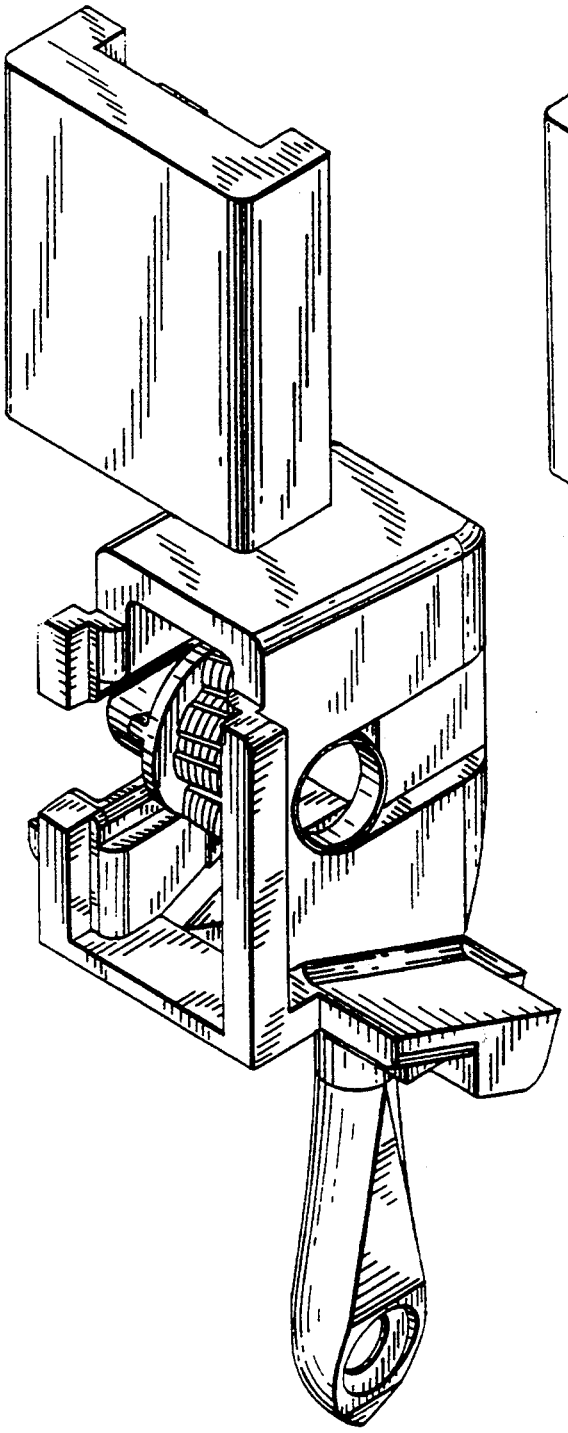
FIG. 15 is a perspective view of a housing for the tilt control gear mechanism with the housing cover detached.
Figure 16:
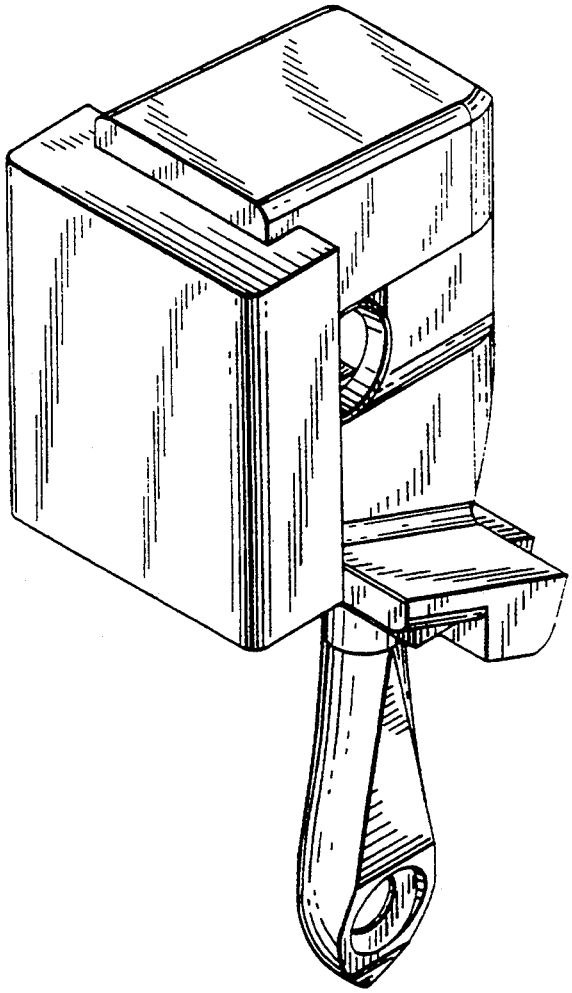
FIG. 16 is a similar view with the housing cover in place.

If reference is now made to FIGS. 15 and 16, the control means housing is illustrated. The control means housing has a slot on one side which has a removable cover. During assembly the control means is inserted through the slot and then the cover is slid into place.

Figure 13:
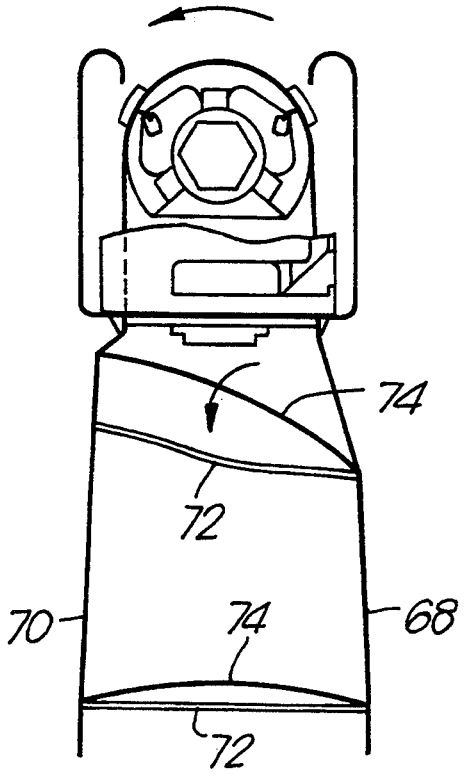
FIG. 13 is a schematic end elevation of a prior art venetian blind tilt mechanism shown with the slats returning to their open position.
Figure 14:
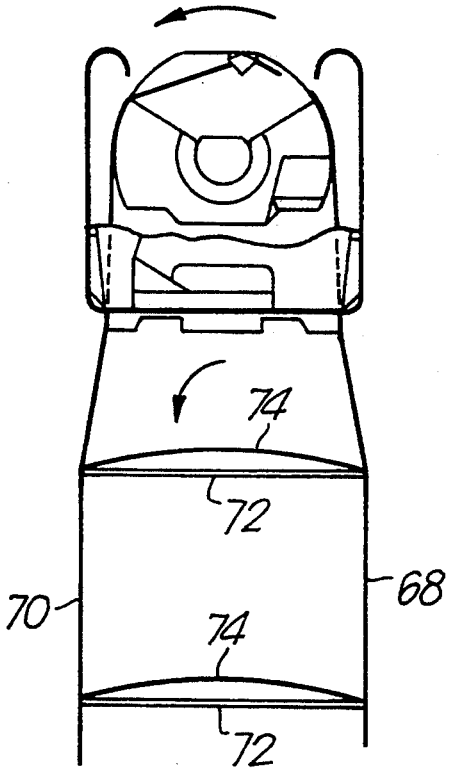
FIG. 14 is a similar view showing the structure of the present invention returning to its open position.

If reference is now made to FIGS. 13 and 14, a prior art structure is illustrated very schematically and it can be seen that the ladder cords 68,70 are shown, at the upper part where they go around the tilt roll 10, so that they are rather steeply inclined inwardly towards one another. When one wishes to tilt the blind from a closed position to the open position, there is a tendency for the top slat 74 to remain engaged with the cord 70 in its original position, and therefore not drop onto to its associated cross ladder as shown in FIG. 13.

It will be recalled that the arrangement of the present invention, particularly as shown in FIGS. 3 and 4, is one in which the guide surfaces 58,60 are as far apart as they reasonably can be and in fact have a spacing substantially equal to the larger dimension of the tilt roll 10, that is to say the horizontal dimension as shown in FIG. 3. Even when the slats are slightly wider than the head rail 40, as shown in FIG. 14, there is little tendency for the cords 70 to remain engaged with the top slat 74 which then drops freely to the horizontal open position.

Experience has shown that best results are achieved if the angle that the cords 68,70 make to the horizontal, above the top slat in the open position, is between 78° and 89°.

We claim:

1. A tilt roll mechanism for a venetian blind comprising, in combination:

a) a ladder lace comprising two laterally spaced elongate flexible cords and a plurality of longitudinally spaced, transversely extending rungs joining said elongate flexible cords;

b) a one-piece body mounted on a support;

c) means on said body adapted to mount said body on said support for rotation about an axis;

d) a peripheral surface on said body about which an end portion of each said elongate flexible cords is at least partly wound, each said elongate flexible cord engaging a portion of said periphery surface on opposing sides of said axis, whereby rotation of said body causes opposite longitudinal movement of said elongate flexible cords, and these tilting of said rungs;

e) at least one pair of generally radially outwardly extending jaws formed integrally on said body, each pair adapted to retainingly engaging one of said elongate flexible cords; and f) at least one pair of generally axially extending arms formed integrally on said body, around which each of said elongate flexible cords are redirected and engaged by said at least one pair of jaws; the end of each respective said elongate flexible cord being redirected back toward it's said opposing side of said axis.

2. The invention of claim 1 wherein said arms are substantially perpendicular in relation to said jaws.

3. The invention of claim 1 wherein the arms have inclined head members on free ends thereof.

4. The invention of claim 1 wherein the spacing between said at least one pair of jaws is less than the thickness of said cord.

5. The invention of claim 1 wherein said redirection lessens stress on the engagement, making that engagement an attachment between said cord and said body.

6. The invention of claim 5 wherein said cords pass through guide surfaces in said support for contacting and thereby guiding said cords, said guide surfaces located closely adjacent said first and second sides of support.

7. The invention of claim 5 wherein said guide surfaces create an angle of between 78° and 89° between a top portion of each said cord above the top slats and the horizontal.

* * * * *